United States Patent [19]

Spielman

[11] Patent Number: 4,963,089

[45] Date of Patent: Oct. 16, 1990

[54] HIGH TURNDOWN BURNER WITH INTEGRAL PILOT

[75] Inventor: Lyle S. Spielman, Rockford, Ill.

[73] Assignee: Eclipse, Inc., Rockford, Ill.

[21] Appl. No.: 397,917

[22] Filed: Aug. 24, 1989

[51] Int. Cl.[5] ..... F23D 15/02

[52] U.S. Cl. ..... 431/351; 431/278; 431/285; 431/352

[58] Field of Search ..... 431/350, 351, 352, 278, 431/284, 285, 353

[56] References Cited

U.S. PATENT DOCUMENTS

| | | | |
|---|---|---|---|
| 2,965,167 | 12/1960 | Campbell | 431/353 |
| 3,050,112 | 8/1862 | Saunders et al. | 341/353 |
| 3,229,748 | 1/1966 | Spielman | 431/353 |
| 3,418,060 | 12/1968 | Spielman et al. | 431/158 |
| 3,586,300 | 6/1971 | Monroe | 431/352 |
| 3,592,578 | 7/1971 | Weatherston | 431/351 |
| 4,023,923 | 5/1977 | Kramer, Jr. | 431/352 |
| 4,373,896 | 2/1983 | Zwick et al. | 431/352 |
| 4,403,947 | 9/1983 | Spielman | 431/353 |

FOREIGN PATENT DOCUMENTS

| | | | |
|---|---|---|---|
| 1268875 | 11/1986 | U.S.S.R. | 431/352 |
| 2066445 | 7/1981 | United Kingdom | 431/353 |

*Primary Examiner*—James C. Yeung

*Attorney, Agent, or Firm*—Leydig, Voit & Mayer, Ltd.

[57] ABSTRACT

An industrial burner in which gaseous fuel is supplied to a mixing and combustion zone within a burner body by way of a conical distribution manifold formed with annular rows of gas discharge ports. A separate passage for pilot gas is formed through the manifold and terminates as an isolated pilot port which discharges a jet of pilot gas for establishing a pilot flame uses to ignite the main gas. Combustor plates surround the gas manifold and are formed with air passages which are so angled and so located as to form canopies of air jets over the fuel jets, the air jets intersecting each other at a significant distance from the center line of the burner.

10 Claims, 3 Drawing Sheets

HIGH TURNDOWN BURNER WITH INTEGRAL PILOT

BACKGROUND OF THE INVENTION

This invention relates generally to a gas-fired burner for use in industrial furnaces, processes or the like.

With increasing energy costs, more sophisticated processes and stricter emission codes, greater demands are being made on burner performance. Burner designs must be more sophisticated in order to meet industrial process turndown requirements which are sometimes in the range of 100:1. Not only must the burner be capable of operating over this wide turndown range but, while doing so, it must maintain short flame lengths, low levels of emission of nitrogen oxides and carbon monoxide, and a relatively low noise level. In addition, the design must be such as to make the cost of the unit competitive with other equipment on the market.

In its simplest form, a burner consists of some type of combustion air manifold, a gas manifold, and some type of flame retention device. The flame retention device is a major factor in determining the operational characteristics of the burner. The earliest forms of burners used a hot refractory burner block in conjunction with the scrubbing action of the flame against the block for flame retention. Since that time, the trend has been toward having some type of flame retention nozzle that does not depend on hot refractory or scrubbing action.

One of the simplest forms of a burner with a flame retention nozzle employs a funnel-shaped air injection manifold in conjunction with gas ports at the narrow end of the funnel and produces turndown ratios in the range of 5:1. Flame lengths and emissions of carbon monoxide and nitrogen oxides generally will satisfy the requirements of only the most basic industrial process.

As the air flows and fuel inputs increase, the ability of the simplest form of retention nozzle to retain the flame diminishes. This results in either a partial or total loss of flame at the nozzle. One type of a higher performance funnel-shaped retention nozzle uses air jets flowing radially in conjunction with a separate retention nozzle which acts to hold the flame inside the funnel section as fuel inputs and air flows are increased. The radial air jets do not intersect until they reach the centerline of the funnel and this tends to give a somewhat longer flame length and slower mixing of the air and fuel.

Another type of a high performance funnel-shaped retention nozzle incorporates a flame retention zone which has special baffling and porting to provide a stable flame in that area of the retention device. This type of nozzle may also use radial jets or it may incorporate tangential air jets which cause the air and fuel to spin and mix somewhat better than the radial jet type. Spinning induces better mixing and produces a somewhat shorter flame.

Both types of high performance retention nozzles mentioned above tend to produce a relatively large amount of fuel burning in the very center of the funnel-shaped combustor. The tangential air jet nozzle must have fairly thick walls on the funnel-shaped section in order to induce spin in the air jets. It is also limited in the angle of divergence of the funnel which makes a very deep funnel necessary if the diameter of the large end reaches any significant size. This is a drawback since larger diameters are necessary as burner inputs increase if flame length is to be kept short. In some industrial processes, it is necessary to make nozzles from heat-resistant stainless steel. With the necessary thick walls and depth of this type of nozzle, the cost of the unit may be too high to make it commercially competitive. The turndown range of this type of nozzle is approximately 40:1.

In order to ignite any burner, it is necessary to provide some sort of pilot which usually is ignited by an electric spark. This can either be a separate pilot or it can be a bypass pilot. Separate pilots are normally small premix type burners.

Bypass piloting is accomplished by admitting a small volume of gas into the main burner gas manifold and igniting it with an electric spark. This type of pilot is very popular because of lower costs and simpler piping. On multiple burner systems, the bypass pilot requires that some type of check valve be installed in the main gas line to restrict the traveling of the pilot gas from burner to burner. This adds to the cost and complexity of a burner system. Bypass pilot input tends to be somewhat higher than separate pilots, which means a higher input in the low firing position. This lowers the effective turndown ratio on the burner.

SUMMARY OF THE INVENTION

The general aim of the present invention is to provide a burner with significantly higher turndowns than existing equipment, low emissions of carbon monoxide and nitrogen oxides, shorter flame lengths, a new integral pilot which overcomes the disadvantages of both the separate pilot and the bypass pilot, and a construction which keeps the cost of the unit competitive with other equipment on the market.

A more detailed object of the invention is to achieve the foregoing by providing a burner having a gas manifold in which one gas port which defines a pilot port is isolated from all the others and is fed by a separate conduit, there being several groups of air jets so angled and so located as to form a canopy over the fuel jets and to intersect each other a significant distance from the center line of the burner.

DETAILED DESCRIPTION OF THE PREFERRED EMBODIMENT

Figure 1:
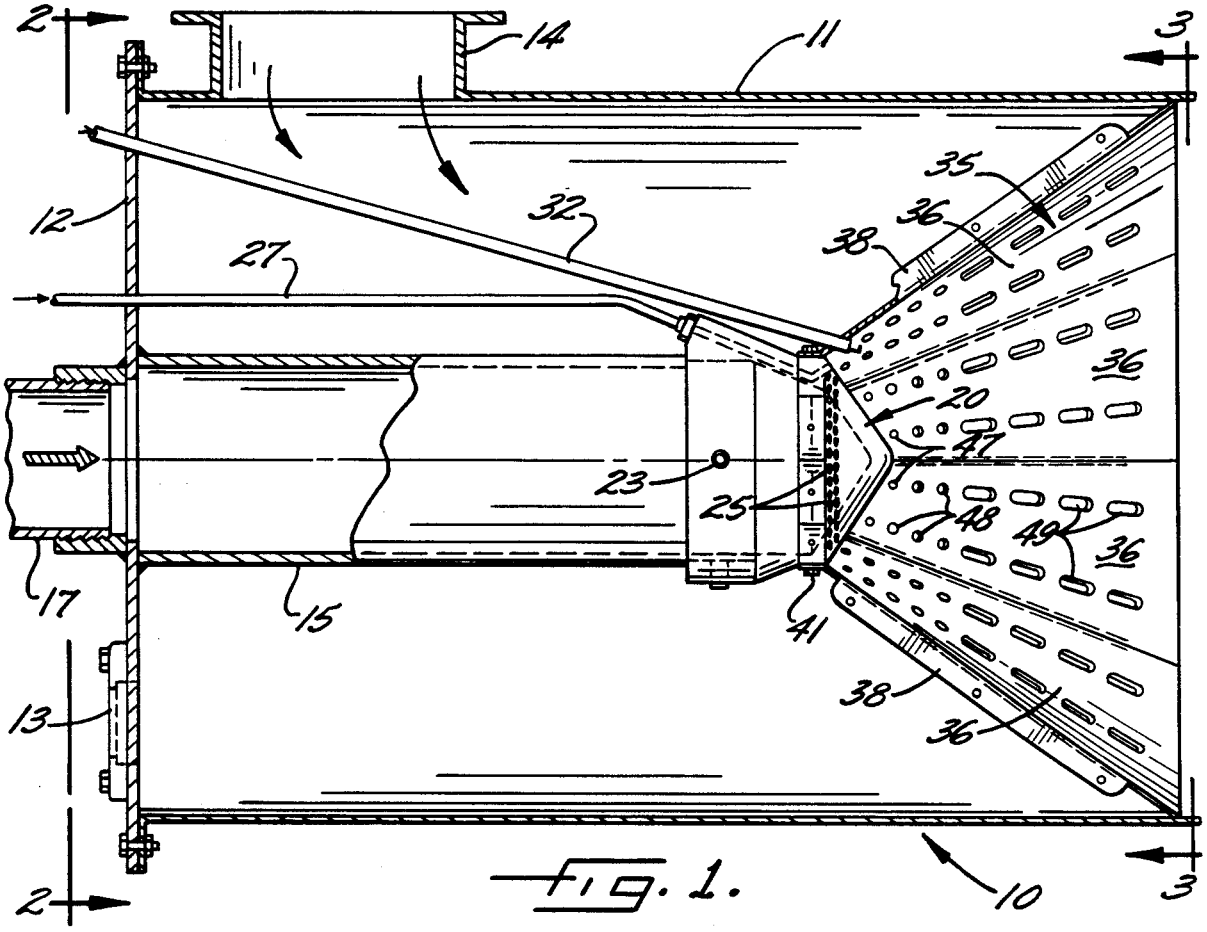
FIG. 1 is a cross-sectional view taken axially through a new and improved burner incorporating the unique features of the present invention.
Figure 2:
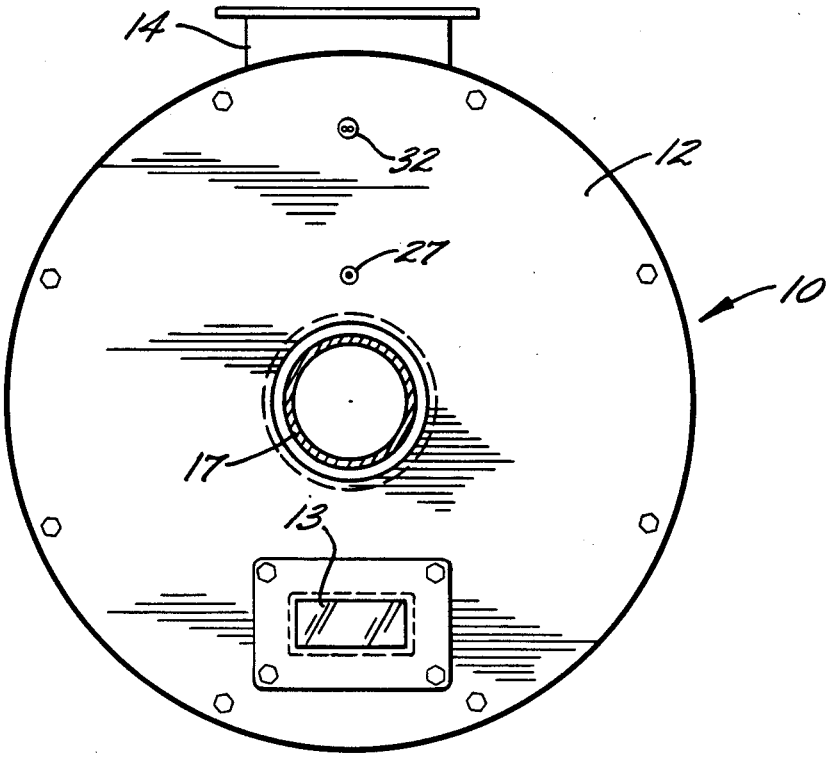
FIG. 2 is an end view as seen along the line 2—2 of FIG. 1.

As shown in the drawings for purposes of illustration, the invention is embodied in an industrial burner 10 in which fuel and combustion air are mixed and ignited in order to produce a high temperature flame. Herein, the burner comprises a cylindrical tubular body 11 whose upstream end is closed by a cover plate 12. A peep sight 13 is incorporated into the plate in order to enable viewing of the flame in the body.

Figure 5:
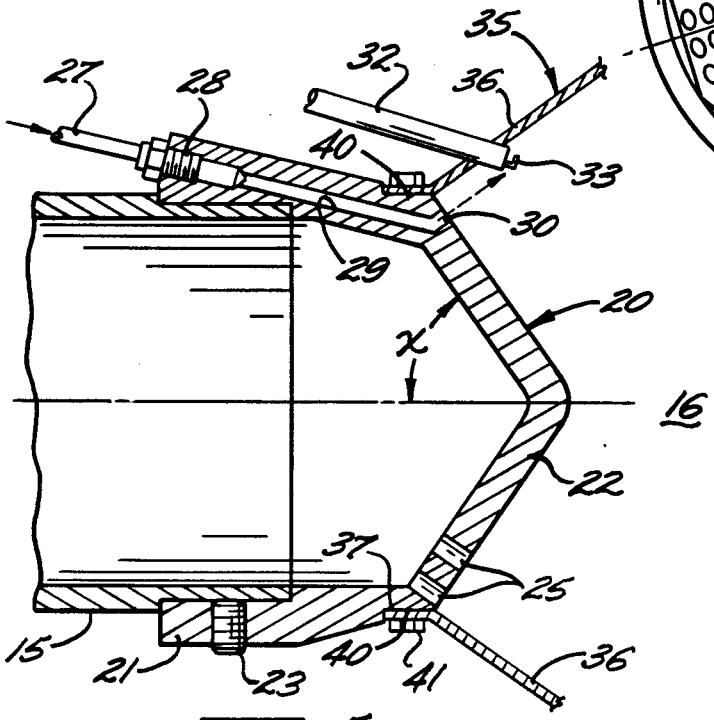
FIG. 5 is a fragmentary cross-section taken substantially along the line 5—5 of FIG. 4.

Combustion air from a blower (not shown) is delivered to the burner body 11 by way of a conduit 14 which extends into one side of the body. A conduit or pipe 15 extends along the central axis of the body and delivers gaseous fuel to a mixing and combustion zone 16 (FIG. 5) in the body from a supply line 17.

Connected to the downstream end of the pipe 15 is a tubular manifold 20 (FIG. 5) which distributes gas from the pipe into the mixing and combustion zone 16. Herein, the manifold includes an upstream portion 21 with a cylindrical wall and a downstream portion 22 with a generally conical wall. The cylindrical portion 21 of the manifold is telescoped over the downstream end portion of the gas pipe 15 and is secured thereto by angularly spaced set screws 23.

The conical wall 22 of the manifold 20 tapers upon progressing downstream and is inclined at an angle X relative to the longitudinal axis of the manifold, the angle being approximately 55 degrees in this particular instance. Ports 25 are formed through the conical wall 22 for the purpose of delivering gas from the manifold 20 and into the mixing and combustion zone 16. Herein, there are two circular rows of angularly spaced ports formed through the wall 22 near the large end of the cone. The ports are perpendicular to the wall 22 and cause the fuel to be discharged in jets.

According to one aspect of the invention, the burner manifold 20 is provided with an integral pilot which requires less gas than either a separate pilot or a bypass pilot and which eliminates the need for check valves in the gas line of multiple burner installations. In this instance, the pilot includes a pilot gas conduit 27 located outside of the gas pipe 15 and connected by a fitting 28 (FIG. 5) to a passage 29 formed in the manifold 20. The passage 29 communicates with a pilot gas port 30 which is formed in the wall 22. The pilot port 30 is located in the wall 22 in the same ring as the outer row of main gas ports 25 but communicates with the passage 29 instead of extending completely through the wall and communicating with the pipe 15. Accordingly, the pilot port 30 is isolated from the pipe 15 and the main gas ports 25. An elongated spark rod 32 is located in the body 11 and includes an electrode 33 which is positioned just downstream of the pilot port 30 to ignite the fuel discharged therefrom.

Further in accordance with the invention, a combustion air shroud 35 coacts with the manifold 20 to define the mixing and combustion zone 16 and to cause canopies of air jets to be formed over the gas jets. The shroud is generally funnel-shaped and flares as it progresses downstream.

Figure 6:
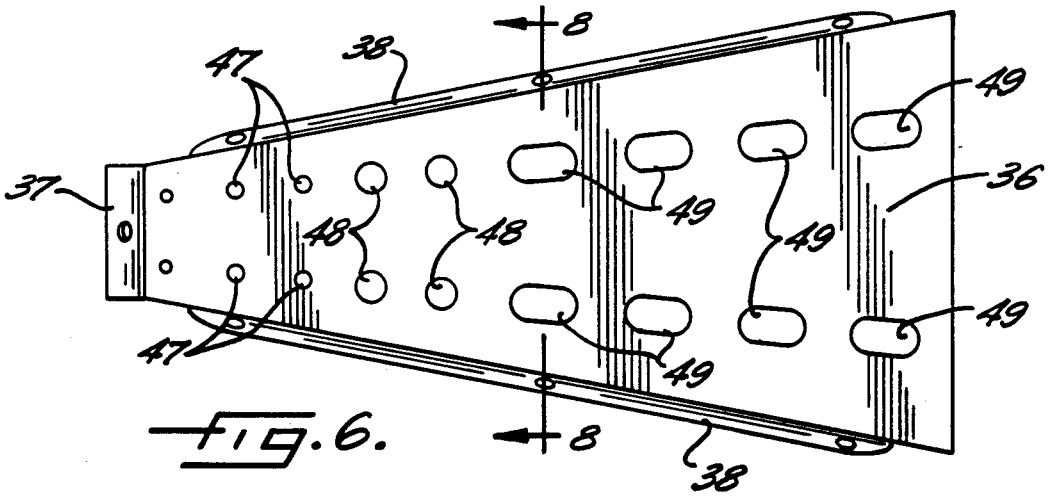
FIG. 6 is a plan view of one of the combustor plates of the burner.
Figure 7:
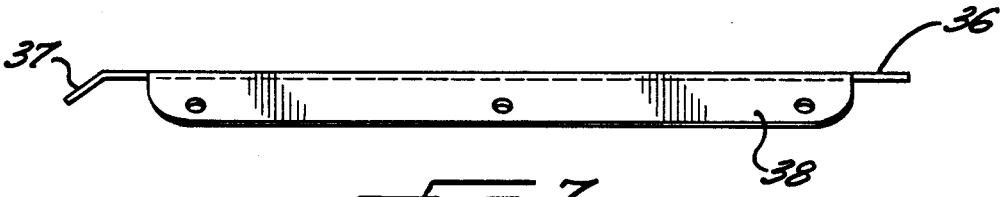
FIG. 7 is a side elevational view of the combustor plate shown in FIG. 6.
Figure 8:
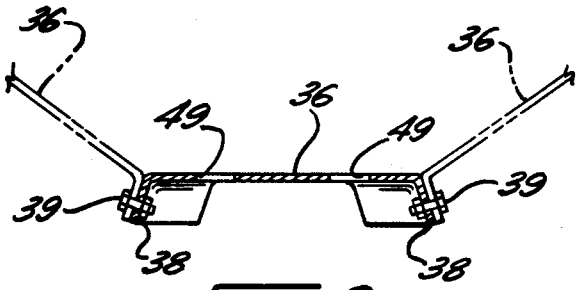
FIG. 8 is a cross-section taken substantially along the line 8—8 of FIG. 6.

While the shroud could be a single-piece casting, it preferably is formed by a series of stainless steel plates 36. One of the plates is shown in detail in FIGS. 6 to 8 and it comprises a flat and generally trapezoidal-shaped member which increases in width as it progresses downstream. A mounting flange 37 is bent from the upstream end of the plate while attaching wings 38 are bent outwardly from the two side edges of the plate.

Figure 4:
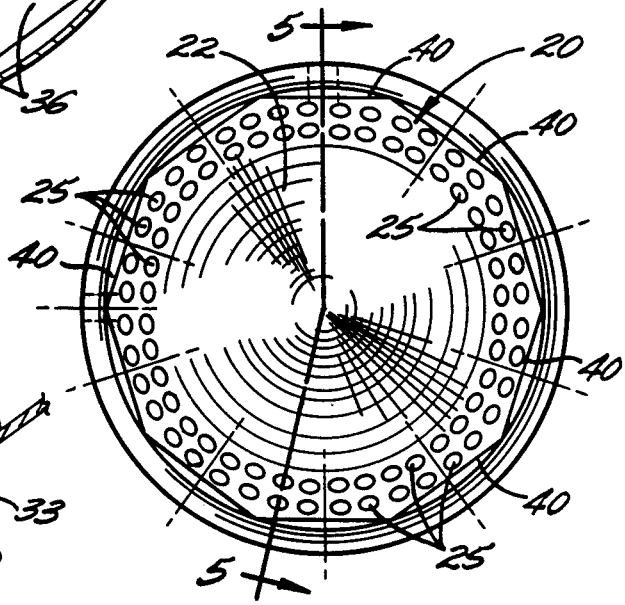
FIG. 4 is an enlarged end view of the gas manifold of the burner.

The plates 36 are secured together in edge-to-edge relation by fasteners 39 (FIG. 8) which extend through holes in adjacent wings 38. The mounting flanges 37 are supported by flats 40 (FIG. 4) which are formed on the manifold 20 between the cylindrical portion 21 and the conical portion 22. Screws 41 extend through the mounting flanges 37 to attach the plates to the manifold. The plates extend substantially perpendicular to the conical wall 22 of the manifold and thus are disposed at an angle of about 35 degrees relative to the longitudinal centerline of the body 11. One of the plates is formed with a hole for accommodating the spark rod 32.

Figure 3:
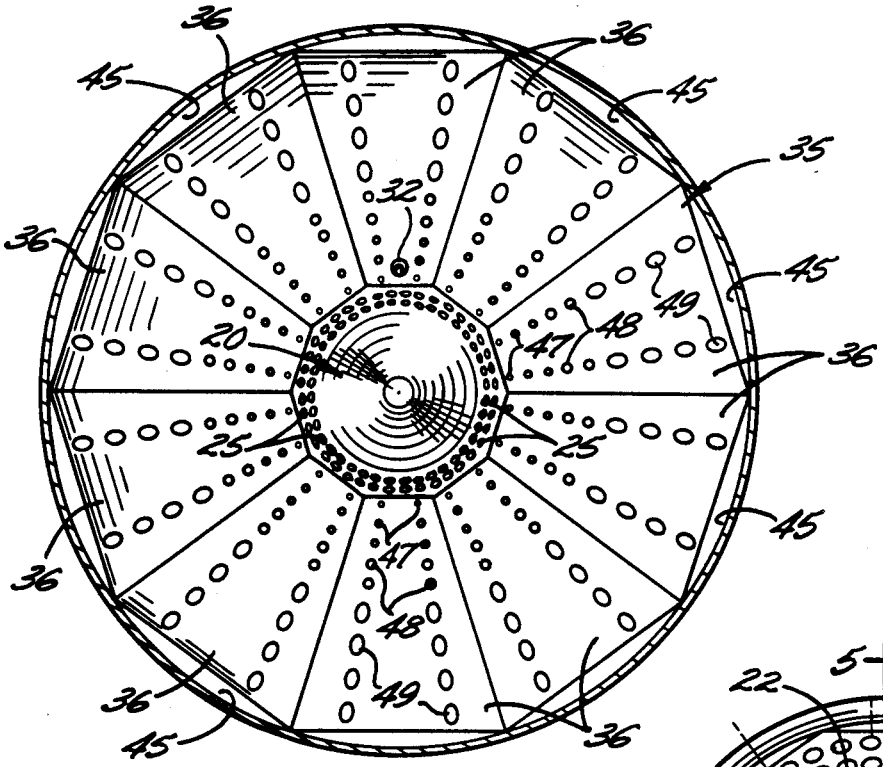
FIG. 3 is an end view as seen along the line 3—3 of FIG. 1.

As a result of the plates 36 being secured together in edge-to-edge relation and being disposed within the cylindrical body 11, combustion air passages 45 (FIG. 3) are defined between the body and the outer, downstream edges of the plates. These passages, however, are not essential to the operation of the burner 10 and may be closed off if desired.

Each plate 36 is formed with combustion air passages which are perpendicular to the plate. In the preferred embodiment, each plate is formed with upstream rows of relatively small passages 47 (FIG. 6), with intermediate rows of somewhat larger passages 48 and with downstream rows of still larger passages 49. Each plate includes two groups of air passages 47 to 49 spaced from one another across the width of the plate. A total of four gas ports 25 are located between each two groups of air passages, two of such gas ports being in the outer circular row of ports and the other two of such gas ports being in the inner circular row of ports. As a result, the gas issuing from angularly adjacent ports 25 passes very close to, and on both sides of, the group of air passages located between such angularly adjacent gas ports.

In operation of the burner 10, combustion air flows through the passages 45 between the body 11 and the plates 36 and also flows through the passages 47, 48 and 49 in each plate. The gas jets issuing from the main ports 25 and the pilot port 30 are attracted to and follow the inner surfaces of the plates 36 by virtue of the suction generated by the air jets flowing through the passages 47 to 49. The gas jets flow on both sides of the passages 47 to 49 and are thoroughly mixed with the intersecting air jets. The intersecting canopy effect of the air jets in conjunction with the gas jets issuing from the ports 25 provides extremely stable combustion without the necessity of a separate retention nozzle or a separate retention zone. The unique relationship between the gas ports 25 and the air passages 48 to 49 also enables an ultrahigh turndown in the range of 500:1 and produces a shorter flame length for a given input. The integral pilot 29, 30 requires lower input than either a separate pilot or a bypass pilot and avoids the disadvantages of such pilots.

I claim:

1. A gas burner comprising a burner body having a mixing and combustion zone, means for admitting combustion air into said mixing and combustion zone, a fuel conduit for gaseous fuel, a fuel manifold communicating with said conduit and having a wall with a series of angularly spaced main fuel ports formed therethrough for discharging said fuel from said conduit and into said mixing and combustion zone for mixture with said combustion air, a single pilot gas port formed through said wall of said manifold, a pilot gas conduit communicating with said pilot gas port and operable to supply a flow of pilot gas through said manifold ny way of said pilot gas port, said pilot gas conduit and said pilot gas port being isolated from said fuel conduit, from said series of main fuel ports and from said combustion air admitting means, and means for igniting the gas discharged from said pilot gas port.

2. A gas burner as set forth in claim 1 further including an annular combustor shroud extending downstream from said manifold and having an inner surface which flares upon progressing downstream, angularly spaced rows of axially spaced air ports formed through said shroud for directing combustion air through said shroud and into said mixing and combustion zone, the wall of said fuel manifold being generally conical and tapering upon progressing downstream, the ports of said series of main fuel ports in said manifold being angled and positioned so as to cause said fuel to be discharged from said manifold in jets which followed the inner surface of said combustor shroud on both sides of each row of said air ports, said air ports being positioned to cause canopies of air jets to be formed over said fuel jets.

3. A gas burner as set forth in claim 2 in which said shroud is formed by a series of flat plates disposed in edge-to-edge relation around said manifold, each of said plates being inclined so as to slope radially outwardly upon progressing downstream, the air ports through each plate being substantially perpendicular to such plate.

4. A gas burner as set forth in claim 3 in which the upstream end of each of said plates is substantially perpendicular to the conical wall of said manifold.

5. A gas burner comprising a burner body having a mixing and combustion zone, means for admitting combustion air into said body for flow to said mixing and combustion zone, a fuel conduit for gaseous fuel, a fuel manifold communicating with aid conduit and having a wall with a series of fuel ports therethrough for discharging said fuel from said conduit and into said mixing and combustion zone, an annular combustor shroud extending downstream from said manifold and having an inner surface which flares upon progressing downstream, angularly spaced rows of axially spaced air ports formed through said shroud for directing combustion air through said shroud and into said mixing and combustion zone, the wall of said fuel manifold being generally conical and tapering upon progressing downstream, the fuel ports in said manifold being spaced angularly from one another around said manifold an being angled so as to cause said fuel to be discharged from said manifold in jets which follow the inner surface of said combustor shroud, there being two angularly spaced fuel ports between each adjacent pair of rows of air ports so as to cause said fuel jets to follow the inner surface of said combustor shroud on both sides of each row of air ports, the inner surface of said shroud being substantially perpendicular to the conical wall of said manifold, and said air ports being positioned to cause canopies of intersecting air jets to be formed over said fuel jets as said combustion air is directed through said air ports, the air jets intersecting at a significant distance from the axially extending center line of said shroud.

6. A burner as set forth in claim 5 in which said body is circular in cross-section, said shroud being formed by a series of flat plates disposed in edge-to-edge relation within said body, there being combustion air passages defined between said plates and said body.

7. A burner as set forth in claim 6 in which said plates are inclined so as to slope radially outwardly upon progressing downstream, the air ports through each plate being substantially perpendicular to the plate.

8. A burner as set forth in claim 7 in which there are upstream, intermediate and downstream air ports, the downstream air ports having a larger area than the upstream air ports.

9. A burner as set forth in claim 8 in which the area of the intermediate air ports is between that of the upstream air ports and that of the downstream air ports.

10. A burner as set forth in claim 5 in which said shroud is formed by a series of flat plates disposed in edge-to-edge relation within said body, adjacent plates being angled relative to one another with there being an obtuse included angle between adjacent plates, each of said plates being inclined so as to progress radially outwardly upon progressing downstream, said air ports being formed through said plates with the ports in each plate being substantially perpendicular thereto.

* * * * *